US009238159B2

(12) United States Patent
Engle, Jr. et al.

(10) Patent No.: US 9,238,159 B2
(45) Date of Patent: Jan. 19, 2016

(54) LOG ROLL

(71) Applicants: AUBURN UNIVERSITY, Auburn, AL (US); VTM, LLC, Auburn, AL (US)

(72) Inventors: Robert C. Engle, Jr., Auburn, AL (US); David F. Dyer, Auburn, AL (US); Richard D. Tatum, Huntington, WV (US); Jason Beebe, Royse City, TX (US); William Bradley Young, Auburn, AL (US); Bradley G. Martin, Auburn, AL (US); Scott R. Young, Chattanooga, TN (US); Vaughn Maceina, Auburn, AL (US)

(73) Assignees: Auburn University, Auburn, AL (US); VTM, LLC, Auburn, AL (US)

( * ) Notice: Subject to any disclaimer, the term of this patent is extended or adjusted under 35 U.S.C. 154(b) by 120 days.

(21) Appl. No.: 14/097,797

(22) Filed: Dec. 5, 2013

(65) Prior Publication Data

US 2014/0162849 A1 Jun. 12, 2014

Related U.S. Application Data

(60) Provisional application No. 61/734,004, filed on Dec. 6, 2012.

(51) Int. Cl.
*A63B 23/04* (2006.01)
*A63B 21/06* (2006.01)
(Continued)

(52) U.S. Cl.
CPC ..... *A63B 23/047* (2013.01); *A63B 21/06* (2013.01); *A63B 21/0618* (2013.01);
(Continued)

(58) Field of Classification Search
CPC ..... A63B 21/0004; A63B 21/00116; A63B 21/00123; A63B 21/00127; A63B 21/0013; A63B 21/0442; A63B 21/0552; A63B 21/06; A63B 21/0609; A63B 21/0618; A63B 21/072; A63B 21/0728; A63B 21/075; A63B 21/08; A63B 21/1484; A63B 21/1492; A63B 21/1496; A63B 21/22; A63B 21/227; A63B 21/285; A63B 2022/0092; A63B 22/20; A63B 23/035; A63B 23/03516; A63B 23/03575; A63B 23/0405; A63B 23/047; A63B 2023/0411; A63B 2208/0223; A63B 2243/0066; A63B 2243/007; A63B 71/04
See application file for complete search history.

(56) References Cited

U.S. PATENT DOCUMENTS 3,011,786 A * 12/1961 Schmuck ..... 473/445
4,838,565 A * 6/1989 Douglas et al. ..... 280/1.5
(Continued)

FOREIGN PATENT DOCUMENTS

RU 00008615 12/1998
RU 00085093 7/2009

OTHER PUBLICATIONS

Power Training Pro, http://www.powerdrivetraining.com/ [retrieved from the internet on Decemer 11, 2013], 2 pages.
(Continued)

*Primary Examiner* — Oren Ginsberg
*Assistant Examiner* — Gary D Urbiel Goldner
(74) *Attorney, Agent, or Firm* — McKee, Voorhees & Sease, PLC

(57) ABSTRACT

A training and exercise device is provided to aid in proper positioning, technique, and muscle memory for different sports and exercise related activities. The training device includes a cylindrical barrel member. A sled or sleds are connected to the barrel member such that rotation and movement of the barrel member will in turn move the sled or sleds. The sleds are bi-directional such that they are able to move in both forward and rear directions, which will allow the training device to be used in multiple directions without having to reorient the entire device between exercises. The barrel device, sled or sleds may also be configured to adjust the weights thereof to increase or decrease the resistance of the movement of the training device to accommodate for different user's size, abilities, and intended outcome.

23 Claims, 8 Drawing Sheets

(51) Int. Cl.

| | |
|---|---|
| ***A63B 21/28*** | (2006.01) |
| ***A63B 21/00*** | (2006.01) |
| *A63B 71/04* | (2006.01) |
| *A63B 21/055* | (2006.01) |

(52) U.S. Cl.

CPC ..... *A63B 21/1484* (2013.01); *A63B 21/285* (2013.01); *A63B 21/4043* (2013.01); *A63B 21/0552* (2013.01); *A63B 71/04* (2013.01)

(56) References Cited

U.S. PATENT DOCUMENTS

| | | | | |
|---|---|---|---|---|
| 5,005,844 | A * | 4/1991 | Douglas et al. | 280/1.5 |
| 5,197,931 | A * | 3/1993 | Wroclawsky | 482/74 |
| 5,690,594 | A * | 11/1997 | Mankovitz | 482/121 |
| 5,743,821 | A * | 4/1998 | Wirachowski | 473/441 |
| 6,612,971 | B1 * | 9/2003 | Morris | 482/74 |
| 6,942,585 | B1 * | 9/2005 | Krause | 473/445 |
| 7,322,905 | B2 | 1/2008 | Morris | |
| D606,611 | S * | 12/2009 | Rogers et al. | D21/788 |
| 7,803,092 | B2 | 9/2010 | Gilliam | |
| 8,100,816 | B2 * | 1/2012 | Daniel | 482/93 |
| 8,328,664 | B2 * | 12/2012 | Krause | 473/445 |
| 8,858,405 | B2 * | 10/2014 | Agate | 482/106 |
| 8,986,172 | B2 * | 3/2015 | Poole | 482/93 |
| 9,017,189 | B2 * | 4/2015 | Leath | 473/445 |
| 2002/0086780 | A1 * | 7/2002 | Morris | 482/136 |
| 2005/0164850 | A1 * | 7/2005 | Leibowitz | 482/93 |
| 2005/0272572 | A1 * | 12/2005 | Lewis | 482/93 |
| 2007/0010384 | A1 * | 1/2007 | Roberts | 482/140 |
| 2008/0312009 | A1 * | 12/2008 | Gilman | 473/445 |
| 2010/0298104 | A1 * | 11/2010 | Turner | 482/93 |
| 2011/0124443 | A1 * | 5/2011 | Krause | 473/445 |
| 2011/0124474 | A1 * | 5/2011 | Gilman | 482/93 |
| 2011/0224050 | A1 * | 9/2011 | Larish | 482/93 |
| 2011/0224051 | A1 * | 9/2011 | Larish | 482/93 |
| 2012/0172155 | A1 * | 7/2012 | Gilman | 473/447 |
| 2013/0012364 | A1 * | 1/2013 | Leath | 482/66 |
| 2013/0023388 | A1 | 1/2013 | English | |
| 2013/0095984 | A1 * | 4/2013 | Agate | 482/106 |
| 2013/0172160 | A1 * | 7/2013 | Poole | 482/129 |
| 2014/0024480 | A1 * | 1/2014 | George | 473/445 |
| 2014/0073491 | A1 * | 3/2014 | Gilson | 482/93 |

OTHER PUBLICATIONS

Predator! PR 65 / PR 65M Scrum Machine, http://www.predator.uk.com/65standard.htm [retrieved from the internet on Dec. 11, 2013], 2 pages.

Sleds, Powerline Sled, http://www.rogersathletic.com/football/sleds/powerline_sled.asp?pid=74 [retrieved from the internet on Dec. 11, 2013], 2 pages.

The Prowler, http://fatbars.com/featured/the-prowler/ [retrieved from the internet on Dec. 11, 2013], 5 pages.

The Prowler 2—Wikipedia, http://en.wikipedia.org/wiki/The_Prowler_2 [retrieved from the internet on Dec. 11, 2013], 2 pages.

SU1757690 A1, VNI KT I Sportivnym Izdeliyam—English. Aug. 30, 1992.

Auburn University, PCT/US2013/073312, "The International Search Report and the Written Opinion of the International Searching Authority, or the Declaration", mail date Mar. 20, 2014.

* cited by examiner

LOG ROLL

CROSS REFERENCE TO RELATED APPLICATIONS

This application claims priority under 35 U.S.C. §119 to provisional application Ser. No. 61/734,004, filed Dec. 6, 2012, which is hereby incorporated by reference in its entirety.

FIELD OF THE INVENTION

The present invention relates generally to training and exercise devices. More particularly, but not exclusively, the invention relates to a training device to aid in proper positioning and muscle memory for different sports related actions.

BACKGROUND OF THE INVENTION

Strength training is becoming much more than the simple pumping iron that it used to be. The top athletes in the world have started participating in full body cardio/strength training combined workouts, and the idea has begun to trickle down to high school sports teams, as well as to the general public. Various sports, such as football, rugby, wrestling, hockey, basketball, lacrosse, and baseball, may require an athlete to exert force to move an opposing athlete, or to resist the opposing athlete's movement. For example, a football player on one side attempts to move (block) another player, while the second player is attempting to resist movement while also attempting to move the first player. Similarly, a baseball catcher attempting to tag a base runner may be called upon to resist the base runner's efforts to collide with the catcher with sufficient force to dislodge the baseball from the catcher's grasp.

In many sports, including those not explicitly mentioned, the movement or resistance of movement may be increased by the proper technique, as well as strengthening muscles associated with the proper technique and movement/resistance. For example, it is known that is ideal to lower one's center of gravity to either begin action to move another, or to resist movement. The lowered center of gravity creates a stronger base for resisting movement and/or beginning to thrust at another. Repetition of lowering one's center of gravity before contacting another creates muscle memory and also increases muscle mass, while decreasing muscle fatigue for the muscles associated with the action.

Therefore, the present invention provides for a training device, system, or apparatus, which provides for repetitive training for athletes and non-athletes alike, to train the muscles of the individuals in the proper technique.

SUMMARY OF THE INVENTION

It is therefore an object, feature, and/or advantage of the present invention to provide a training device for providing proper technique and muscle training.

It is another object, feature, and/or advantage of the present invention to provide a training device that promotes a user to maintain a low stance and to keep one's head up controlling where he/she is going.

It is yet another object, feature, and/or advantage of the present invention to provide a training device that is be able to be kept out exposed to the weather for extended time without deteriorating its quality/function and be easily transportable for times of relocation.

It is still another object, feature, and/or advantage of the present invention to provide a training device that is modular in that it can be set up to be used by a single person or by up to five or more persons at a time.

It is a further object, feature, and/or advantage of the present invention to provide a training device that is weight adjustable to allow users of various sizes and abilities to be able to operate.

It is still a further object, feature, and/or advantage of the present invention to provide a training device that is at least bi-directional in use.

It is yet a further object, feature, and/or advantage of the present invention to provide a training device that can be used by one person at a time or multiple people at the same time.

These and/or other objects, features, and advantages of the present invention will be apparent to those skilled in the art. The present invention is not to be limited to or by these objects, features and advantages. No single embodiment need provide each and every object, feature, or advantage.

Generally, the disclosed invention is a training and exercise device that mimics or otherwise is similar to a rolling log. The core of the device is a cylindrical object laid horizontally on the ground. The cylinder can be moved (preferably pushed) by a user as a means of exercise and as a means of training for certain physical attributes, such as hand/foot co-ordination, cardiovascular exercise, strength training, that can be useful in certain sports, such as football, rugby, wrestling, hockey, basketball, lacrosse, and baseball, or for general physical training.

In some embodiments, an axle runs along the axis of the cylinder. This axis can then be linked to a sled or sleds or other devices that increase resistance for the user. In some instances, these sleds or other devices can have a means to have adjustable resistance, such as vertical pegs to receive and hold free weights. Additional embodiments include addition of tires, or containers to hold water, sand, or other readily available heavy materials. The log itself can be hollow, allowing for the introduction of additional weight, such as through the addition of water or sand.

The sled or sleds, which are bi-directional sleds, disclosed herein can be used in conjunction with the log roll device, but may also be able to be used independently with other training devices or methods. Further, the system could be modified to allow for improved indoor usage. This includes, but is not necessarily limited to, the addition of material underneath the resistance devices or sleds to reduce abrasion against flooring, such as hardwood/parquet floors commonly found in basketball gyms. For example, carpet, felt, blankets, cotton, silk, or some similar cloth material can be secured around the base of the bi-directional sleds.

Therefore, according to some aspects of the invention, a training device is provided. The training device includes, at least in part, a cylindrical member, and at least one sled operatively attached to the cylindrical member. The at least one sled is movable in both a forward and rearward direction. Furthermore, the at least one sled is moved in a direction relative to the direction of rotation of the cylindrical member. The cylinder may include a compliant cover, such as a closed cell foam material, substantially covering the outer surface area of the cylinder. The sled, which may be multiple sleds, can be adjusted to increase the resistance provided by the sled or sleds for a user attempting to move the training device. This can be done by adding weights to the cylindrical member and/or sled or sleds.

According to additional embodiments of the invention, a training device is provided. The device includes, at least in part, a cylindrical member, an axle extending at least partially through the axis of the cylindrical member and being operatively connected to the cylindrical member such that the axle is able to rotate independently thereof, and at least one sled operatively attached to the axle. The at least one sled is movable in both a forward and rearward direction, and is capable of being moved in a direction relative to the direction of rotation of the cylindrical member.

According to additional embodiments of the invention, a training device is provided. The training device includes, at least in part, a hollow cylindrical member including a compliant member substantially covering the outer surface area of the cylindrical member, an axle extending at least partially through the axis of the cylindrical member and being operatively connected to the cylindrical member such that the axle is able to rotate independently thereof, a first sled member operatively connected to a first end of the axle, and a second sled member operatively connected to a second end of the axle. The first and second sled members capable of sliding in either forward or backward directions based upon the direction of movement of the cylindrical member.

Figure 1:
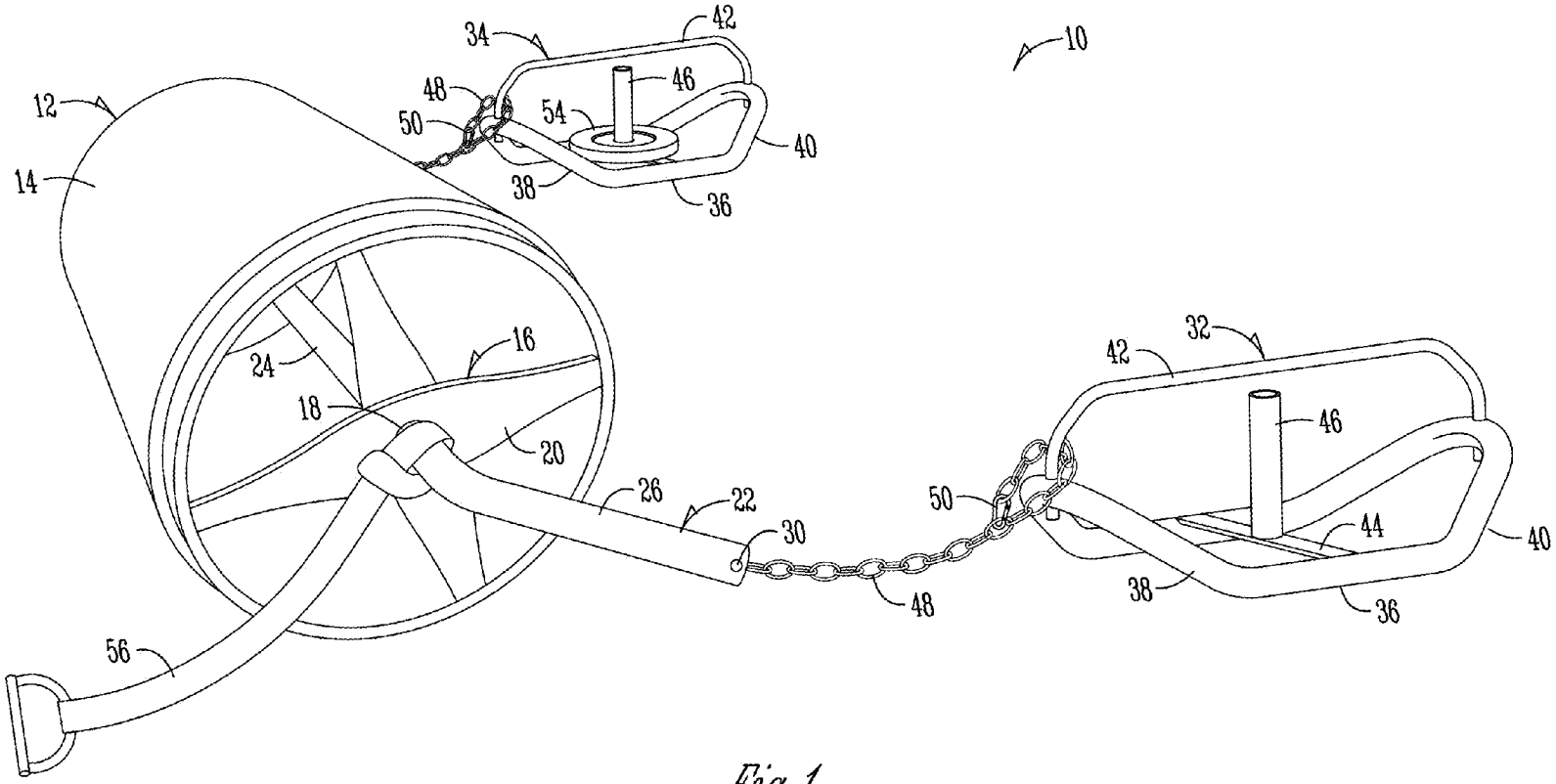
FIG. 1 is a perspective view of the training device of the present invention.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENTS

The present invention relates to a training and/or exercise device 10, which mimics or otherwise is similar to a rolling device, such as a log. Components of the training and/or exercise device 10 include a cylindrical object 12, which may also be known as a log or a barrel. The cylinder 12 is laid upon a surface, such as the ground. A user pushes the cylindrical device 12 to roll the cylinder as a means of exercise and training for certain physical attributes, such as hand foot coordination, cardiovascular exercise, strength training, or technique training. In addition, a sled or sleds are attached to the cylindrical object 12, such that the sleds provide some resistance to the rolling of the cylindrical object 12. For example, there may be first and second sleds 32, 34, which are attached at opposite sides of the cylindrical object 12 to provide resistance when a user is pulling, pushing, or otherwise rolling the cylindrical device 12. In addition, an aspect of the invention provides that the sled or sleds may be bi-directional, such that the training device 10 can be used in either a forward or a reverse direction. This is advantageous over previous training devices in that the training device 10 does not have to be rotated or re-oriented to use in a different direction. Thus, when the training device is used in an area with limited space, the device can be used in a back and forth direction to optimize the limited amount of space for training and/or exercising. The bi-directional aspect of the training device 10 also increases the number of drills, exercises, etc. that can be done using the training device 10.

Therefore, the figures show various aspects, components, and embodiments of the training device 10 according to the present invention. For example, FIG. 1 is a perspective view of an embodiment of the training device 10. As shown in FIG. 1, a cylindrical object 12 is provided. The cylindrical object 12, which may also be known as a barrel, can comprise generally any rigid or semi-rigid material, e.g., PVC pipe, steel, other plastics, or rubber materials. According to some embodiments, the barrel 12 is an 18-inch or 24-inch PVC pipe. However, as has been mentioned, other sizes, and types of materials may be utilized with the present invention. For example, the invention contemplates various diameters for the barrel 12, which can be selected based upon the age, size, ability, and other factors of the user. It is contemplated that the barrel device 12 have a diameter between 12 and 48-inches, although the invention to is to be limited as such. The length of the barrel 12 may also vary. According to some embodiments, the length of the barrel may be approximately 3-feet. However, as with the diameter, the length of the barrel 12 may also be varied according to the user, as well as the type of training. For example, if multiple people are to use the training device at the same time, the barrel may be of a longer length to account for the additional person or persons.

In addition, when a PVC pipe or other material having a low coefficient of friction, is used to form the cylindrical object 12, a cover 14 may be positioned generally around the outer surface area of said pipe. The cover 14 is used to provide greater friction between the barrel device 12 and the ground. For example, PVC has a lower coefficient of friction than rubber, such that the PVC material may slip when rolled on some surfaces. The addition of a cover 14 will increase the coefficient of friction between the barrel device 12 and the ground such that the barrel device 12 will roll easily without or with mitigating slippage.

In addition, the cover material 14 can be selected such that it provides some comfort for a user of the training device 10. Therefore, the present invention contemplates that the cover can be used with any material used for the barrel 12. Some embodiments contemplate that the cover 14 comprises hydro turf or other polymer. The hydro turf material is a soft, durable, and weather resistant material. Other types of materials considered to be used as a cover 14 for the barrel device 12 may include ethylene vinyl acetate (EVA) foam. Such type of foam is a closed cell foam type material, which increases comfort while providing a water resistant material. It should be appreciated that other types of materials not specifically mentioned may also be utilized with the invention, including various types of foam, rubber, plastic, or other composite. In addition, instead of having a cover material surrounding the PVC pipe creating the barrel device 12, it is contemplated that the barrel device 12 comprises a compliant or otherwise semi-rigid material. For example, the invention contemplates that the barrel device 12 comprises a rubber material with or without tread thereon. The rubber material will provide comfort to a user, while also providing friction between the barrel device 12 and the ground. Still further types of materials are contemplated to be used as both the cover and/or barrel device. Such materials may include, but are not limited to, foams, rubbers, plastics, or other composites.

As shown generally in FIGS. 1-5B, the barrel device 12 may be a hollow device. However, it should be appreciated that in iterations of the training device 10, the barrel device 12 may not be hollow, and instead can include a cavity or cavities, which can be filled to increase the weight of the barrel device 12 to increase the resistance of the training device 10. Furthermore, the barrel device 12 may be partially hollow such that material may be added or removed from an interior cavity of the barrel device 12 to vary the weight of the barrel device 12 to vary the resistance of rolling the device. The present invention is not to be limited to the exact configuration shown in the figures.

Whether or not a hollow barrel device 12 is used, the present invention contemplates the use of an axle 22 extending through the barrel device 12. The axle 22 includes a central portion 24 aligning generally with the central axis of the cylindrical barrel device 12. Furthermore, as shown in the figures, the axle 22 will extend beyond the length of the barrel device 12 and can include first and second bent portions 26, 28, along with the central portion 24. However, it should also be appreciated that the axle comprises multiple and/or separate sections. For example, instead of extending the length of the barrel and beyond, the axle may comprise shorter pieces that extend slightly into and away from the barrel 12. In both situations, the axle is able to rotate independently of the barrel device 12. The axle 22 shown in the figures is held in place by the use of a bearing member or assembly 16 positioned at or near the ends of the barrel 12. The bearing member 16 may be a single member with an aperture 18 therein, which is held in place by a plurality of spokes 20 spaced radially about the bearing member 16. For example, the spokes 20 may comprise turnbuckles, such that the precise length can be obtained for each of the spokes to center the bearing member 16 at or near the opposite ends of the barrel device 12. The turnbuckles would be set to the same length to position the axle in line with the axis of the barrel 12, and would be affixed to both the barrel member 12 and the bearing member 16. The bearing member 16 could also include ball bearings or other types of friction reducing members to further allow the independent rotation of the barrel device 12 relative to the axle 22. Thus, the axle 22 in the barrel device 12 will be able to rotate independent of one another during use of the training device 10.

Figure 5A:
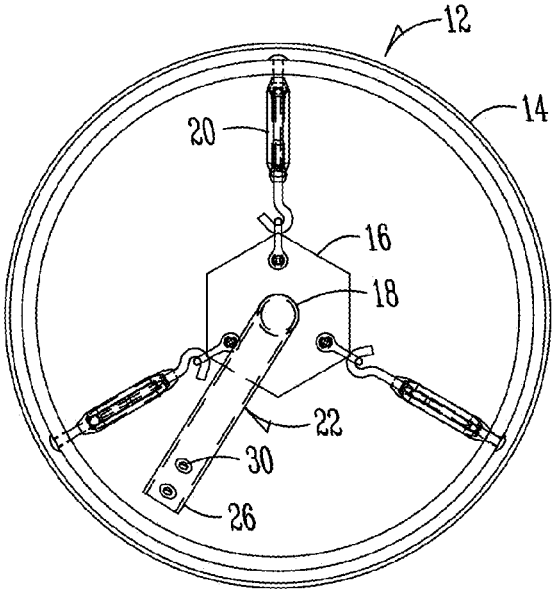
FIG. 5A is a side elevation view of an embodiment of the barrel assembly of the training device.
Figure 5B:
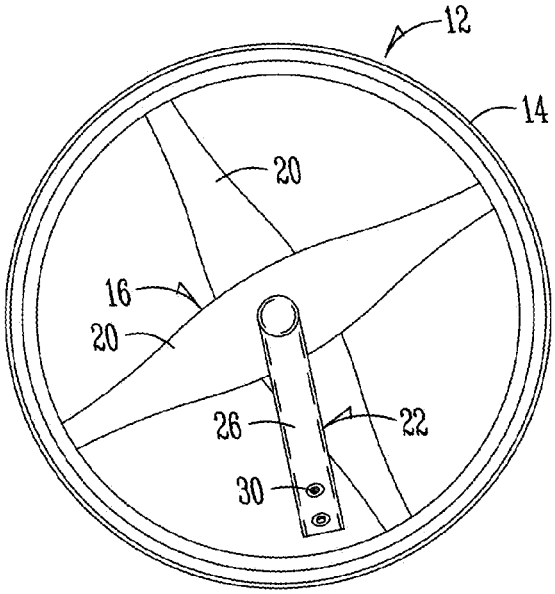
FIG. 5B is a side elevation view of another embodiment of the barrel assembly of the training device.

In addition, the bearing member 16 may take the form of first and second spoke members 20, which are sized in length to the inner diameter of the barrel device 12. The spoke members 20 in FIG. 5B may be steel members that are fixed to the interior of the barrel 12. As shown in FIGS. 1 and 5B, the first and second spoke members 20 will have a central aperture therein which is aligned to allow the axle 22 to pass therethrough. The ends of the first and second spoke members 20 are attached or otherwise affixed to the barrel device 12 to hold the spoke members in place. Thus, the aperture 18 of the spoke members 20 will generally align with the axis of the barrel device 12 such that the axle 22 will pass through the central axis of the barrel device 12. Therefore, the bearing member or spoke members 16 are used to position the axle 22 in general alignment with the central axis of the barrel device 12. The alignment of the axle 22 and the axis of the barrel device 12 will allow the barrel device 12 to be rolled while the central portion 24 of the axle 22 remains in a generally fixed location relative to the barrel device 12. This will improve the efficiency of the training device 10. This can be seen best in FIG. 4, which shows the central portion 24 of the axle 22 in dash lines passing in alignment with the axis of the barrel device 12.

The axle 22 can comprise a coated steel pipe, which is also known as EMT pipe. A diameter of the axle 22 may be one and one-quarter inch, however, it is to be appreciated that additional diameters of pipes may be used, and the exact dimension of the axle is not essential to the invention. In addition, apertures, such as an aperture 30 shown in the figures, may be made in the axle 22 to allow the axle 22 to attach to other members of the training device 10, as will be described herein.

Figure 2:
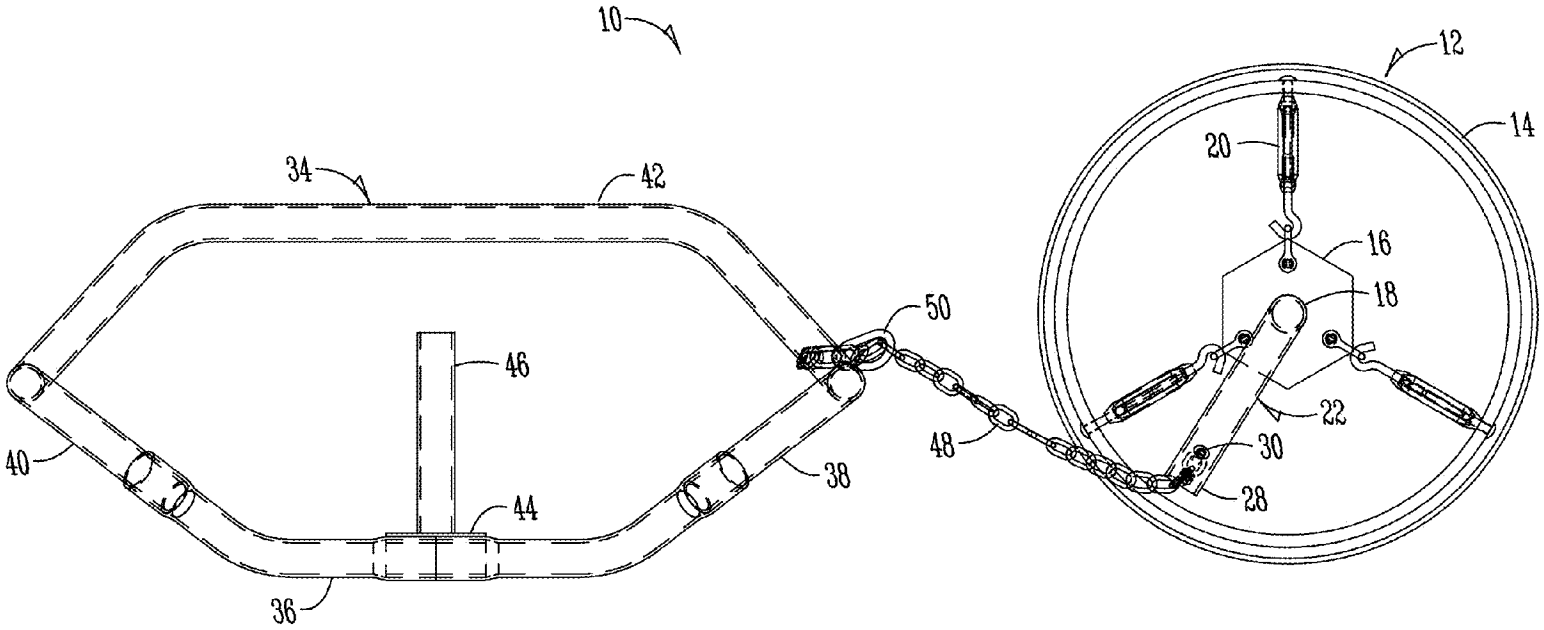
FIG. 2 is a side elevation view of the training device.
Figure 3:
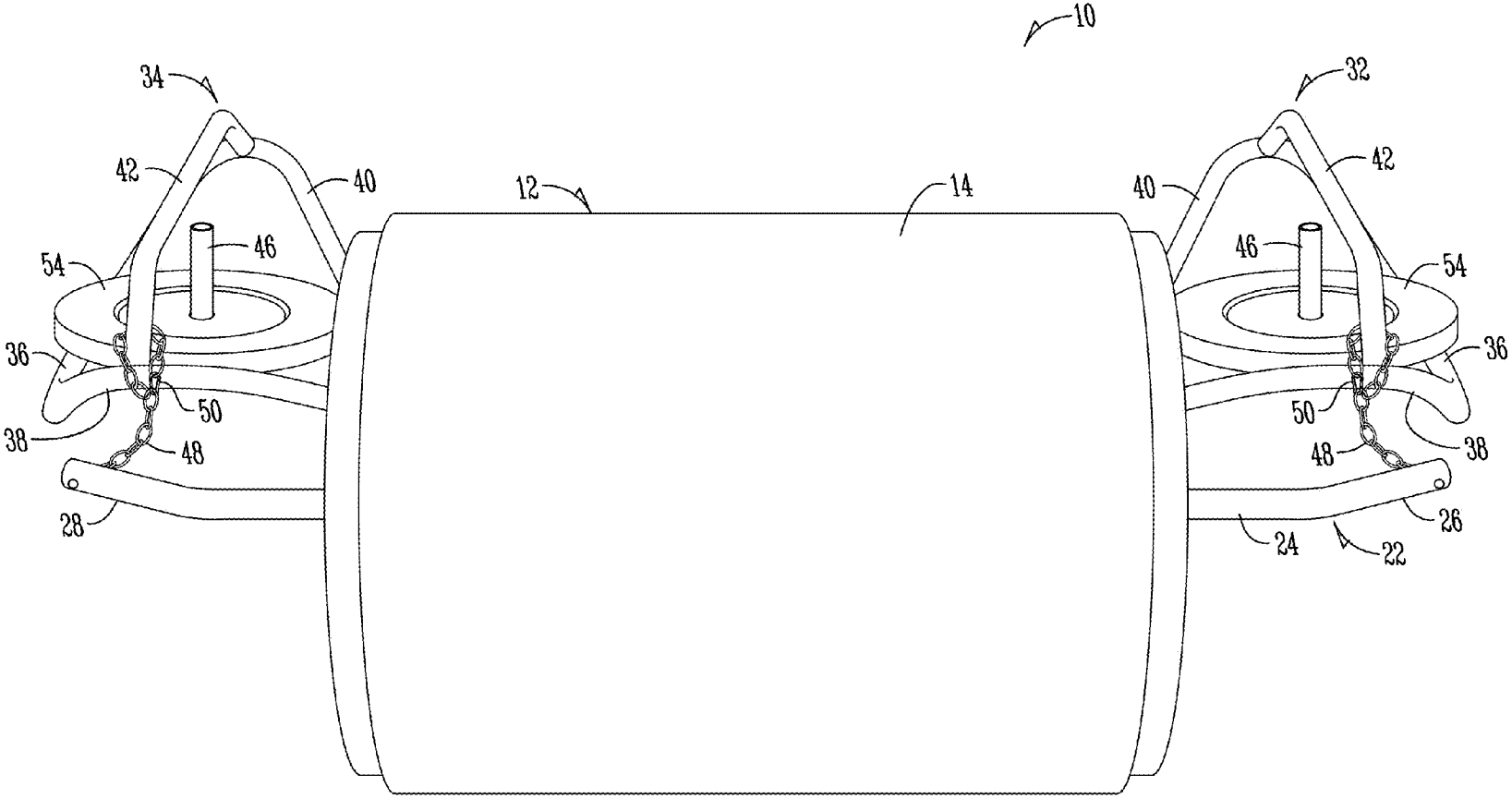
FIG. 3 is a front elevation view of the training device.
Figure 4:
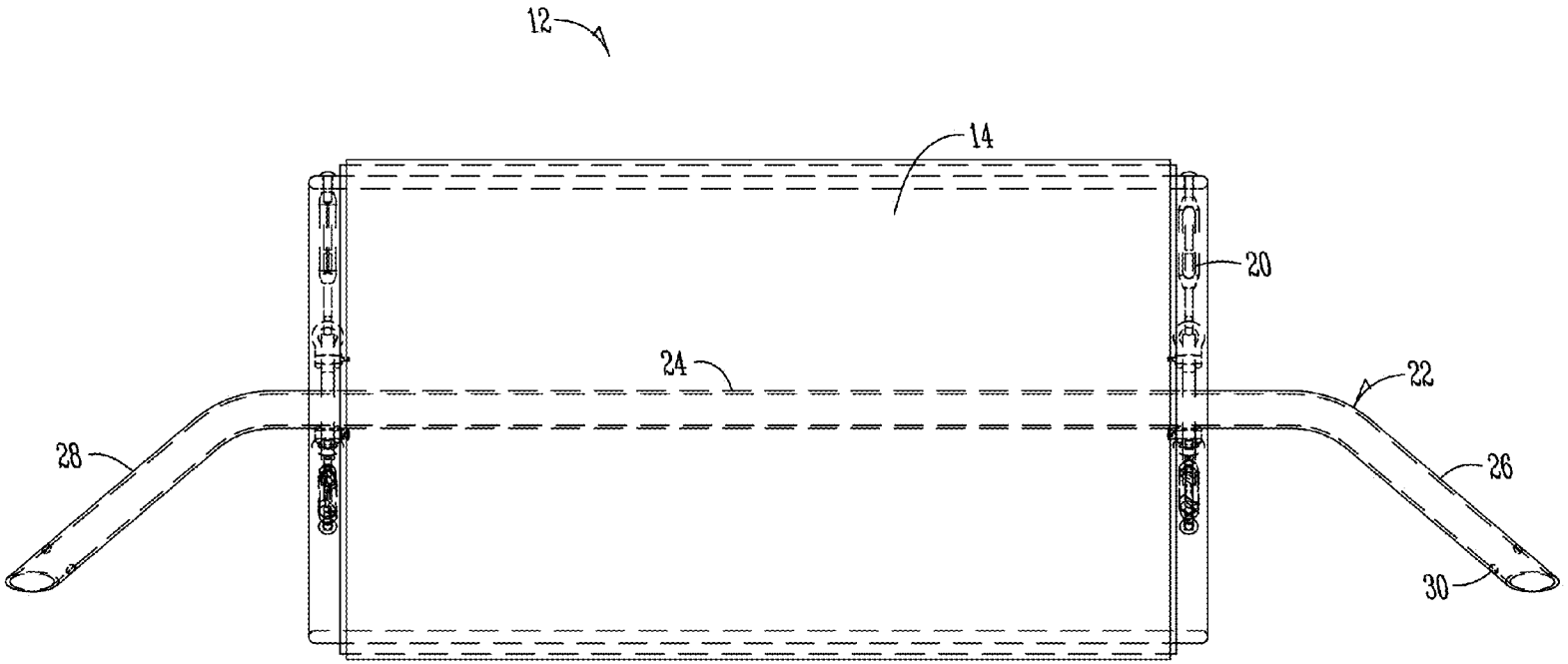
FIG. 4 is a front elevation view of the barrel assembly of the training device.

FIGS. 1-3 show additional aspects of the training device 10 according to embodiments of the invention. To increase the resistance of the rolling of the barrel device 12, one or more sleds may be operatively connected to said barrel device 12. As shown in the figures, first and second sleds 32, 34 are operatively attached to the axle 22 at the bent portions 26, 28 of the axle 22 via chains 48. The sleds 32, 34 may also be known as resistance members, as they provide resistance to the rolling of the barrel member 12 during use of the training device 10. Therefore, it should be appreciated, that while the figures show aspects of sleds 32, 34 used with the barrel member 12, the invention contemplates that the sleds or other resistance members may take additional forms. This may include, but is not limited to, bungee or other resistance cords, wheels, weights, boards, or essentially any other object that may provide resistance to the movement of the barrel member 12 by the rolling of said member. Virtually any weighted member or rolling member that includes resistance can be attached to the barrel member 12 in the place of the sled or sleds to be used as resistance members for the training device of the present invention.

Figure 9:
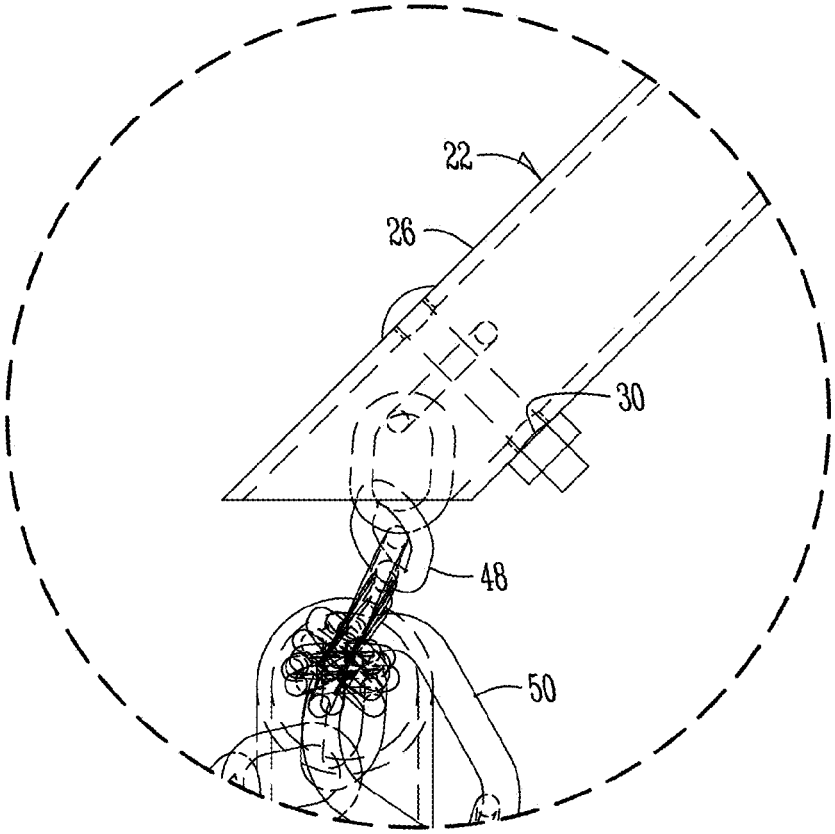
FIG. 9 is an enlarged view of a portion of the axle of the training device.

When the barrel device 12 is rolled in a particular direction, the independent connectivity of the axle 22 will provide that the axle 22 does not roll, which allows the axle 22 to pull the sled members 32, 34, which increases the resistance of the training device 10. Thus, the increased resistance of the training device 10 during operation provides for muscle training, cardio vascular training, and other muscle memory techniques to provide a user with a desired outcome of a workout. The sleds 32, 34 may be connected to the axle 22 via chain 48 or other connecting member, which can be attached to the axle aperture 30. As shown best in FIG. 9, a link of the chain 48 can be attached via an eyebolt to a nut and bolt passed through the aperture 30 of the bent portion 26 of the axle 22. However, the present invention contemplates that additional means and methods of attaching the chain 48 to the axle may be included and considered part of the present invention. Furthermore, at the sled member 32, the chain 48 can be wrapped around a portion of said sled member 32 and can be connected to itself via a carabineer 50. A carabineer 50 connects to links of the chain 48 around a portion of the sled member 32.

The connection of the chain 48 at the sled member 32 will allow the wrapped portion of the chain 48 to move from one end of the sled member 30 (a front portion) to the opposite end of the sled member 32 (the rear portion). This allows the sleds 32, 34 to be bi-directional. The bi-directional features of the sled members 32, 34 allows the training device 10 to be used in a forward or reverse manner, which is advantageous over previous training devices, which can only be used in one direction. The training device 10 does not have to be rotated or otherwise re-oriented when reaching a certain location, and can simply be used in the opposite direction to provide for additional training or exercise drills. Furthermore, while a chain 48 is provided to attach the sled members 32, 34 to the barrel device 12, it should be appreciated that any connecting member can be used, which is able to withstand the forces acting upon said connecting member. A chain is but one member capable of meeting these requirements, but the present invention is not to be limited to said use of a chain. A steel chain is strong enough to tolerate the constant force applied during the exercise and use of the training device 10, and will not bind when switching directions from one direction to the opposite direction.

The sled members 32, 34, which are shown in FIGS. 1, 2, 3, 6, 7 and 8, are configured to be able to slide or otherwise be moved in a bi-directional manner. As has been mentioned, it is advantageous for the present invention to be able to be used in such bi-directional manner to increase the amount of usage of the training device 10, especially when confronted with limited space. The bi-directional configuration of the sleds 32, 34 also allow the training device 10 to be used for more drills. Furthermore, while the figures show the use of first and second sled members 32, 34, it should be appreciated that the present invention should not be limited as such. For example, it is contemplated that a single sled member be used with the present invention, or that the sled members 32, 34 shown in the figures be connected to one another such that they form a single sled unit. In addition, additional barrel members 12 and sled members 32, 34 may be connected to one another to provide for a longer training or allow multiple users to use the device 10 at the same time.

Figure 6:
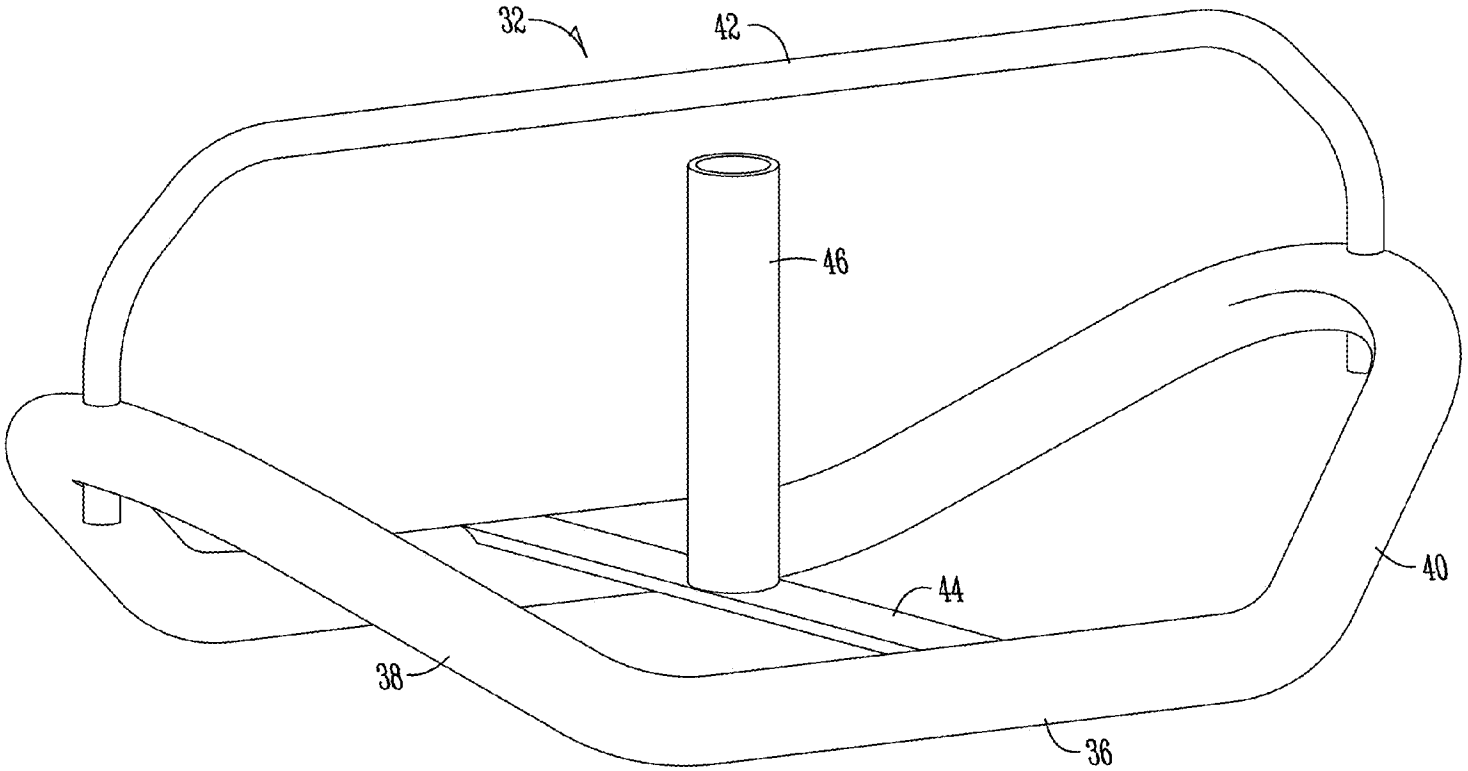
FIG. 6 is a perspective view of a sled member of the training device.
Figure 7:
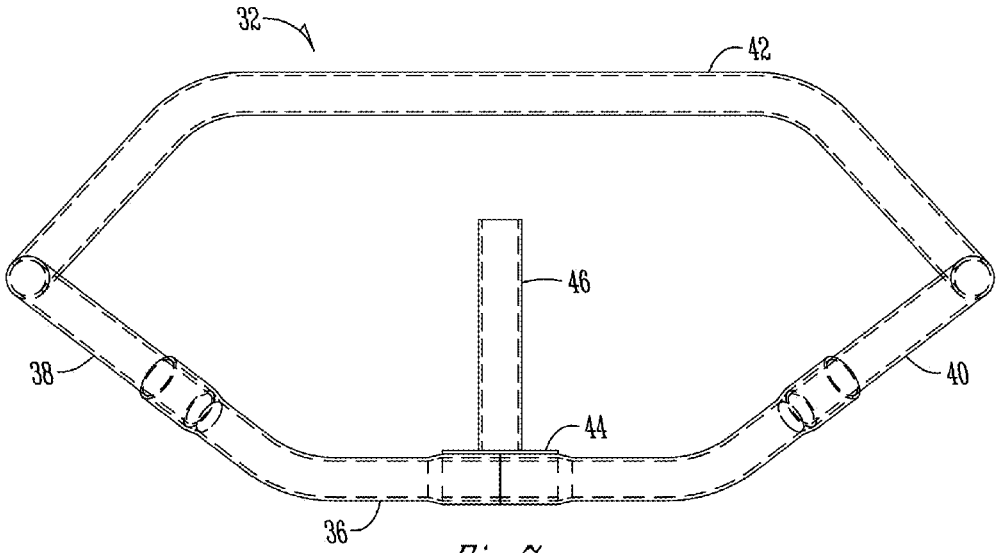
FIG. 7 is a side elevation view of the sled member of the training device.
Figure 8:
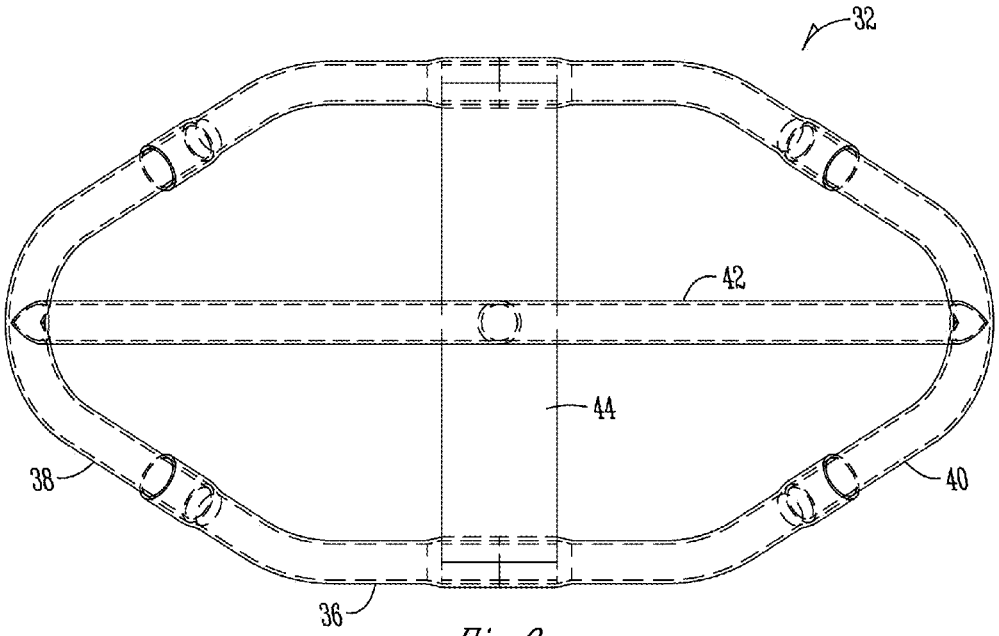
FIG. 8 is a top elevation view of the sled member of the training device.

As shown throughout the figures, the first and second sled members 32, 34 are substantially identical to one another. Therefore, only one sled will be described with regard to the components thereof, with the other sled comprising substantially the same components in substantially the same manner. As shown in FIG. 6, the sled member 32 includes parallel sliding bars 36. The sliding bars 36 contact the ground and are slid in relation to the said ground during use of the training device 10. The sliding bars 36 are shown to be circular pipes, but it should be appreciated that they make take other forms, such as skis, wheels, square tubes, or the like. At a forward end of the sliding bars 36 is a bent portion or raised portion 38. The bent or raised portion 38 at the front of the sled member 32 extends from one sliding bar 36 to the other. The upward sloping of the front bent portion 38 allows the sled member 32 to be slid in the direction traveled with the front portion in the front, without the front portion 38 catching or otherwise being restricted during travel. At the opposite or rear end of the sled 32 is an upward sloping rear bent portion 40. Similar to the front portion 38, the rear bent portion 40 is an upward sloping portion, which extends from one sliding bar 36 to the other. As shown in FIG. 7, the front and rear portions are generally mirror images of one another in terms of their slopes. This allows the sled 32 to be used in either direction without having to change orientation of the sleds.

Extending generally above and from the front of the sled 32 to the rear of the sled 32 is a connection or arched connection bar 42. As shown in FIGS. 1 and 2, the chain or other connection member 48 can be wrapped around or otherwise attached to the connection bar 42 of each sled 32, 34. The chain 48 is attached to the connection bar 42 such that it is able to move (slide) along the connection bar 42. Thus, when the direction of the barrel 12 and/or training device 10 is reversed, the connection member or chain 48 can simply slide along the connection bar 42 to reposition itself at the opposite end of the sled member 32 to quickly and easily allow for the opposite direction of sliding of travel of the sled members 32, 34. This is advantageous, as it allows for quick and easy reversal of the direction of travel of the sled members 32, 34, without requiring a user to physically change any aspect of the training device 10. Instead, the opposite direction of movement of the barrel device 12 will reorient the connection members and direction of travel of the sled members 32, 34 on its own.

Also shown in the figures of the sled 32 is a plate member 44 extending generally from one slide bar 36 to the other. The plate may be attached to each of the slide bars 36, such as by welding. Attached to and extending from the plate 44 is a vertical bar 46. The plate 44 and vertical bar 46 may be used to increase the weight of the sled members 32, 34, which will increase the resistance of the training device 10. For example, as shown in some figures, a weight 54, such as a free weight, may be added to the sled members 32, 34 at the vertical bar 46. A free weight 54 can be slid upon the vertical bar 46 and rested on the plate 44. The vertical bar 46 will prevent the weight 54 from moving on the sled member 32 during use of the training device 10, and the plate 44 will provide a surface for the weight 54 to reside upon such that the weight 54 will not contact the ground. Thus, substantially the only portion of the sled members 32, 34 riding on the ground will be the sliding bars 36 and/or front or rear upward sloping portions 38, 40, which provides for the ideal or desired amount of resistance between the sled members 32, 34 and the ground.

The various components of the sleds 32, 34, except for the plate, can comprise a coated steel pipe, such as an EMT pipe. However, other shapes and materials may also be used to make the sleds, such as square tubing, PVC pipes, or even other plastics, rubbers, or composites. The diameters of the steel pipe can vary depending upon the desired size of sled. The plate 44 may also comprise a steel material to be able to support a weighted member 54 held thereon. The portions of the sleds 32, 34 can be welded to one another to form the sleds. However, the smooth transition between the portions 38, 40 of the sleds 32, 34 may be desired or otherwise preferred. For example, as the connection chain 48 is configured to ride along the arched bar 42 of the sled members 32, 34, it will be preferred that the connection bar 42 does not include obstructions thereon, which could prevent or otherwise slow down or reduce the movement of the chain 48 on the connection bar 42. Furthermore, obstructions on the sliding bars 36 and/or front and rear bent 38, 40 or sloped portions of the sleds 32, 34 can increase the resistance between the sled members 32, 34 and the surface, which can cause unintended circumstances to arise when using the training device 10.

While the figures of the present invention include the use of first and second sled members 32, 34, it is contemplated that the invention includes only a single sled member. For example, another connection member (not shown) may extend from a portion of a first sled 32 to a portion of the second sled 34. For example, a connection member may rise from one of the sliding bars 36 of the first sled member 32, crossover, and then extend downwardly to a sliding bar of the second sled member 34. Such a bar could form an arch between the first and second sled members 32, 34. This would connect the sled members 32, 34 to provide only a single sled. The arched connection bar (not shown) between the first and second sled members 32, 34, could provide advantages to the training device 10. For example, the connection bar could be set at a height such that a user must remain below the height of the connection bar before contacting the barrel device 12. This would provide an additional training aspect to teach a proper technique to an individual using the training device 10 to stay low and to lower one's center of gravity while continually moving forward. The connection between the first and second sled members 32, 34 could also provide that the sled members 32, 34 will move in unison. For example, the invention contemplates that multiple users may use the training device 10 at the same time. Thus, the users will align side-by-side and will try to contact the barrel device 12 at the same time to begin movement thereof. Connecting the first and second sled members 32, 34 to form a single sled member will aid in keeping the sled members 32, 34 generally parallel to one another during rolling of the barrel device 12, regardless of whether one user is moving at a faster pace then said other user. Other advantages obvious to those skilled in the art may also arise from the use of connecting the first and second sled members 32, 34 to form a single sled member.

However, it is also contemplated that the sleds be designed such that they are best used in a mono-directional manner. For example, only one end of the sled or sleds need be upwardly sloped to be best moved in that direction. The opposite end may be any manner, such as ending at a portion that is substantially parallel to the ground. This would provide for ease of sliding in one direction, but not as much in the opposite direction. In addition, other variations of sleds can be used that do not have any sort of upward-sloped portion. The sleds are to be used for purposes of providing resistance, and in many instances, variable resistance, so as to provide a variable training device that can be used by persons of variable age, size, ability, strength, and/or other capabilities.

Other aspects of the invention are shown in the figures. For example, a strap or straps 56 may be connected to the axle 22, as is shown in FIG. 1. The strap 56 can be connected to the axle 22 with an open end such that a user is able to grab the open end or another portion of the strap 56. The strap would allow a person to pull the training device 10, as opposed to pushing the device by rolling the barrel member 12. As the axle member 22 is able to rotate independent of the barrel member 12, the pulling on the axle 22 on opposite sides of the barrel member 12 will cause the barrel member 12 to begin to roll, which provides an additional workout or training exercise for a user.

Furthermore, pieces of material may be added to the sliding bars 36, front slope bars 38, and/or rear slope bars 40 of the sled members 32, 34 to reduce or increase the friction between the sleds 32, 34 and a surface. In addition, material may be placed under the sled members 32, 34 to allow for greatly flexibility of use of the training device 10. For example, a cloth material or other material may be attached to the sled member on the bottom side thereof to allow the training device 10 to be used on an otherwise damageable surface, such as a hardwood, parquet, tiled, or other indoor surface. The training device 10 could be used in a larger number of areas, and in a greater number of weather conditions, such as during inclement weather when a user is not able to use the device outside. Some examples of materials that can be used with the training device may include carpet, felt, blankets, cotton, silk or some combination thereof that can be secured around the portions of the bi-directional sleds 32, 34 to allow the sleds to be used on the indoor surfaces, while mitigating the damage to the indoor surfaces. The addition of the cloth materials will not substantially decrease the resistance of the sleds such that the effective of the training device 10 will still be maintained. The sleds 32, 34 could also be manipulated to allow for indoor or outdoor use. As mentioned, the sleds may take different forms to provide resistance to the movement of the barrel member 12. Therefore, different forms of the resistance devices could be used depending on the surface to which the device 10 is to be used, so as to provide minimal damage and high benefits from use of the training device, no matter the location or surface. Furthermore, it should be appreciated that the cover 14 of the barrel 12 will provide or otherwise allow the barrel 12 to be used on said damageable surfaces as well.

While the training device 10 of the invention may be used in any number of ways, a few exemplary methods of use will be provided. For example, the training device 10 can be positioned such that the barrel device 12 is positioned ahead of the sled members 32, 34 with the sled members 32, 34 attached to the axle 22 of the barrel device 12. Weights 54 can be added to the sled members 32, 34 and/or barrel device 12 to increase the resistance of the training device 10 for some users. A user may be positioned between or behind the sled members 32, 34 and facing the barrel device 12 in an athletic position. Upon an action, the user explodes or otherwise moves towards the barrel device 12, and begins contacting the barrel device 12 with the user's hands to begin rolling the barrel device 12. The connection of the barrel device 12 to the weighted sled members 32, 34 will increase the resistance felt by the user in attempting to rotate the barrel device 12 to move the training device 10. The movement is continued for a said amount of time and/or distance, upon which the user stops. Continued repetitions of said exercise can continue to provide training and/or exercise for a user.

In addition, due to the bi-directional functionality of the sleds 32, 34, the device 10 does not need to be rotated to be reoriented in the opposite direction, and instead can simply be pushed in the opposite direction quickly and easily. This allows for greater efficiency in training or using the training device 10 of the present invention. Furthermore, the bi-directional functionality of the training device 10 can be used in a training exercise for a single user or multiple users. For example, a user may begin pushing and/or rolling the device 10 in a forward direction for a predetermined distance, upon reaching said distance, the user may quickly re-orient themselves on the opposite side of the barrel device 12 and begin moving the device back in the opposite or rear direction thereof. The continued back and forth directional movement of the user and training device 10 will provide additional training and/or exercise. Furthermore, multiple people can use the training device 10 such that one user will move the device in a forward direction for a certain time and/or distance, upon which another user will begin moving the training device 10 in the opposite direction. Such a situation will provide for a greater amount of training for multiple users, while reducing the amount of time for the training and/or exercise.

Furthermore, as mentioned, the strap 56 may be utilized with the training device 10 to provide for additional training and/or exercise. The strap 56 allows a user to pull the training device 10, as opposed to pushing the barrel member to roll the barrel device 12. The pushing and pulling of the device 12 will work different muscles of the user, such that the same training device will provide a number of exercises to work various muscle groups of a user, which may be needed for different sports. As will be understood, the training device 10 is not to be limited to the specific exercises and/or training techniques described, and can be used in generally any manner to provide for training, technique, and exercise for a user.

A training device has heretofore been shown and described. It should be appreciated that many variations may be made to the training device of the present invention, some of which have not been explicitly stated. The description of the training device has been shown for exemplary purposes, and contemplates many variations. For example, the size of the various components of the training device may be varied according to a specific training for different sports and/or exercises. For example, when the training device is used to train for football related activities, the device may be varied in size accordingly. The length of the barrel device may be increased to provide for multiple users using the device at a single time. This would mimic an offense or defensive line working together to move the training device. Furthermore, the size of the training device may be varied according to user skill and/or level. As the training device will provide training for good technique for a variety of sports, it may be beneficial to begin using the device at a young age. However, as a youth may be smaller in stature, the components of the training device may be shrunk or otherwise sized accordingly to allow the youth to be able to use the device in a proper manner. The size and thus, weight of the device can be increased as a user increases in age, size, and athletic ability, to accommodate the ever-changing abilities of a user. Other variations apparent to those skilled in the art are also to be included as part of the invention.

What is claimed is:

1. A training device, comprising: a cylindrical member; and first and second sled members operatively connected to opposite ends of the cylindrical member; wherein the first and second sled members are configured to be moved in a first direction relative to a first direction of rotation of the cylindrical member; wherein a second direction is opposite the first direction; wherein a second direction of rotation of the cylindrical member is opposite the first direction of rotation of the cylindrical member; and wherein the first and second sled members are configured to be moved in the second direction relative to the second direction of rotation of the cylindrical member without having to re-orient the first and second sled members.

2. The training device of claim 1 wherein the first and second sled members each comprise: a first end and a second end opposite the first end; and upwardly sloped sections at the first and second ends of each of the first and second sled members.

3. The training device of claim 2 wherein an upper member extends from a front to a rear of each of the respective first and second sled members, and the first and second sled members are each capable of sliding.

4. The training device of claim 3 further comprising an axle extending through the cylindrical member such that portions of the axle extend outside the cylindrical member, wherein the axle is capable of rotating independent of the cylindrical member.

5. The training device of claim 4 further comprising first and second bearing members positioned at the opposite ends of the cylindrical member, with the axle extending through the first and second bearing members.

6. The training device of claim 5 further comprising: a first connecting member extending between the first sled member and a first end of the axle; and a second connecting member extending between the second sled member and a second end of the axle opposite the first end of the axle.

7. The training device of claim 1 further comprising a compliant cover portion substantially surrounding an outer surface area of the cylindrical member.

8. The training device of claim 7 wherein the compliant cover portion comprises an ethylene vinyl acetate (EVA) foam.

9. The training device of claim 1, wherein the first and second sled members each comprise an adjustable weight portion comprising a plate and a holding member extending from the plate, the holding member able to receive a weight.

10. The training device of claim 1 wherein the first and second sled members are movable in both a forward and rearward direction.

11. A training device, comprising: a cylindrical member; an axle extending at least partially through the axis of the cylindrical member and being operatively connected to the cylindrical member such that the axle is able to rotate independently thereof; and first and second sled members operatively connected to opposite ends of the cylindrical member; wherein the first and second sled members are configured to be moved in a first direction relative to a first direction of rotation of the cylindrical member; wherein a second direction is opposite the first direction; wherein a second direction of rotation of the cylindrical member is opposite the first direction of rotation of the cylindrical member; and wherein the first and second sled members are configured to be moved in the second direction relative to the second direction of rotation of the cylindrical member without having to re-orient the first and second sled members.

12. The training device of claim 11 wherein the cylindrical member is substantially hollow.

13. The training device of claim 12 further comprising first and second bearing members positioned at opposite open ends of the cylindrical member.

14. The training device of claim 13 wherein the axle extends through and beyond the first and second bearing members.

15. The training device of claim 14 wherein the axle includes bent portions near each opposite end of the axle.

16. The training device of claim 15 wherein the first and second sled members each comprise: a first end and a second end opposite the first end; and upwardly sloped sections at the first and second ends of each of the first and second sled members.

17. The training device of claim 16 further comprising a first chain extending between the first sled member and a first bent portion of the axle and a second chain extending between the second sled member and an opposite bent portion of the axle.

18. The training device of claim 17 wherein a portion of the first chain connected to the first sled member is capable of moving from one end of the first sled member to an opposite end of the first sled member and a portion of the second chain connected to the second sled member is capable of moving from one end of the second sled member to an opposite end of the second sled member.

19. A training device, comprising:

a hollow cylindrical member including a compliant member substantially covering the outer surface area of the hollow cylindrical member;

an axle extending at least partially through the axis of the hollow cylindrical member and being operatively connected to the hollow cylindrical member such that the axle is able to rotate independently thereof;

a first resistance member operatively connected to a first end of the axle; and a second resistance member operatively connected to a second end of the axle;

wherein the first and second resistance members are configured to be moved in a first direction relative to a first direction of rotation of the hollow cylindrical member; wherein a second direction is opposite the first direction; wherein a second direction of rotation of the hollow cylindrical member is opposite the first direction of rotation of the hollow cylindrical member; and wherein the first and second resistance members are configured to be moved in the second direction relative to the second direction of rotation of the hollow cylindrical member without having to re-orient the first and second resistance members.

20. The training device of claim 19 wherein the first and second resistance members comprise first and second sled members.

21. The training device of claim 20 wherein the first and second sled members are capable of sliding in either forward or backward directions based upon a direction of movement of the hollow cylindrical member.

22. The training device of claim 21 further comprising first and second bearing members at first and second ends of the hollow cylindrical member, with the axle extending at least partially through and beyond each of the first and second bearing members.

23. The training device of claim 21 further comprising: a first chain extending between the first sled member and the first end of the axle; and a second chain extending between the second sled member and the second end of the axle opposite the first end of the axle.

* * * * *